US011067072B2

(12) United States Patent
Ruppert et al.

(10) Patent No.: US 11,067,072 B2
(45) Date of Patent: Jul. 20, 2021

(54) DIAPHRAGM PUMP FOR DOSING A FLUID AND AN ACCORDING METHOD

(71) Applicants: Ecolab USA Inc., Saint Paul, MN (US); Andreas Ruppert, Siegsdorf (DE); Wolfgang Sauer, Bischofswiesen (DE)

(72) Inventors: Andreas Ruppert, Siegsdorf (DE); Wolfgang Sauer, Bischofswiesen (DE)

(73) Assignee: Ecolab USA Inc., Saint Paul, MN (US)

( * ) Notice: Subject to any disclaimer, the term of this patent is extended or adjusted under 35 U.S.C. 154(b) by 546 days.

(21) Appl. No.: 15/532,371

(22) PCT Filed: Dec. 1, 2014

(86) PCT No.: PCT/EP2014/076144
§ 371 (c)(1),
(2) Date: Jun. 1, 2017

(87) PCT Pub. No.: WO2016/086959
PCT Pub. Date: Jun. 9, 2016

(65) Prior Publication Data

US 2017/0328357 A1 Nov. 16, 2017

(51) Int. Cl.
*F04B 43/04* (2006.01)
*F04B 49/06* (2006.01)
(Continued)

(52) U.S. Cl.
CPC ..... *F04B 43/04* (2013.01); *F04B 13/00* (2013.01); *F04B 49/06* (2013.01); *F04B 49/20* (2013.01); *F04B 2203/0209* (2013.01)

(58) Field of Classification Search
CPC ..... F04B 49/02; F04B 49/125; F04B 49/20; F04B 2201/1208; F04B 2203/0209;
(Continued)

(56) References Cited

U.S. PATENT DOCUMENTS

2001/0025890 A1* 10/2001 Fujimoto ..... H01L 21/6715 239/1
2005/0206340 A1* 9/2005 Brundle ..... A61M 5/142 318/685
(Continued)

FOREIGN PATENT DOCUMENTS

CN 103688053 A 3/2014
CN 103712043 A 4/2014
(Continued)

OTHER PUBLICATIONS

Definition—Controller (Year: 2016).*
(Continued)

*Primary Examiner* — Essama Omgba
*Assistant Examiner* — Christopher J Brunjes
(74) *Attorney, Agent, or Firm* — Fredrikson & Byron, P.A.

(57) ABSTRACT

A diaphragm pump (10), in particular for use as a detergent dosage pump, comprises a pump housing (12) with at least a first check valve (14) and a second check valve (16), a fluid chamber (18), a diaphragm (20) defining a wall of the fluid chamber (18) and reciprocatingly movable, a stepping motor (28) as driving means for reciprocating said diaphragm (20), wherein the stepping motor (28) comprises a controller (34) for actuating the stepping motor (28), and an external control unit (36) for operating the controller (34) of the stepping motor (28), wherein the external control unit (36) is connected to the controller (34) by a power supply line (38) for transmitting an operating signal (42, 46) to the controller (34), wherein the operating signal (42, 46) is a start signal for operating the diaphragm pump (10), in particular the stepping motor (28), at preset parameters. The diaphragm pump (10) according to the invention offers increased cost efficiency of the diaphragm pump (10) by integrating the
(Continued)

power supply and the transfer of operating signals from the control unit (36) to the controller (34).

15 Claims, 3 Drawing Sheets

(51) Int. Cl.
*F04B 49/20* (2006.01)
*F04B 13/00* (2006.01)

(58) Field of Classification Search
CPC ..... F04B 9/045; F04B 13/00; F04B 17/03; F04B 2201/0201; F04B 2203/0213; F04B 43/04; F04B 43/082; F04B 43/02; F04B 43/043; F04B 45/04; F04B 45/047; F04B 17/042; F04B 17/04; F04B 35/045; F04B 49/06; F04B 49/065
See application file for complete search history.

(56) References Cited

U.S. PATENT DOCUMENTS

2007/0175916 A1* 8/2007 Oldham ..... A23B 9/24 222/1
2007/0253832 A1* 11/2007 Kenney ..... B01L 3/0213 417/53
2007/0296606 A1* 12/2007 Godager ..... E21B 47/182 340/853.1
2011/0204832 A1* 8/2011 Zavodny ..... H02P 23/0004 318/400.3
2014/0197138 A1* 7/2014 Yoshizaki ..... B23H 7/18 219/69.12
2014/0345261 A1* 11/2014 Schuller ..... F16H 61/0031 60/327

FOREIGN PATENT DOCUMENTS

| | | | |
|---|---|---|---|
| DE | 4413513 | A1 | 10/1995 |
| DE | 19623537 | C2 | 3/2002 |
| EP | 0376497 | A1 | 7/1990 |
| EP | 1065380 | A1 | 1/2001 |
| EP | 1895675 | A2 | 3/2008 |
| JP | 2005-168104 | A | 6/2005 |
| JP | 2008055143 | A | 3/2008 |
| JP | 2012-016122 | A | 1/2012 |
| JP | 2013-051794 | A | 3/2013 |
| WO | 2014166550 | A1 | 10/2014 |

OTHER PUBLICATIONS

International Patent Application No. PCT/EP2014/076144, International Search Report and Written Opinion dated Jul. 24, 2015, 9 pages.

* cited by examiner

| Bits | Function |
|---|---|
| 0 | Start-Bit (5ms Low, 5 ms High) |
| 1, 2, 3 | Pump identifier<br>000 = 20 l (Detergent), max. back pressure 3bar*<br>001 = 2,5 l (Detergent), max. back pressure 10bar*<br>010 = 1,4 l (Rinse), max. back pressure 10bar*<br>011 = 0,3 l (Rinse), max. back pressure 10bar* |
| 4, 5, 6, 7, 8, 9, 10 | 7 bits, RPM<br>Binary coded, 1 ... 100%<br>Orientation: MSB – LSB |
| 11 | Stop-Bit (5ms Low, 5 ms High) |

DIAPHRAGM PUMP FOR DOSING A FLUID AND AN ACCORDING METHOD

RELATED APPLICATIONS

This application is a 35 U.S.C. 371 national stage filing from International Application No. PCT/EP2014/076144, filed Dec. 1, 2014, the entire contents of which are incorporated herein by reference.

TECHNICAL FIELD OF THE INVENTION

The present invention relates to a diaphragm pump, in particular for use as a detergent dosage pump, and an according method of dosing a fluid.

BACKGROUND OF THE INVENTION

Diaphragm and piston pumps are used to supply metered quantities of liquids with various properties. Depending on the field of application, the pump behaviour is subject to various requirements in order to ensure that the delivered quantity of the metered medium is as precise as possible and remains constant for as long as possible.

Diaphragm pumps are common industrial pumps that use positive displacement to move liquids. These devices typically include a single diaphragm and chamber, as well as discharge check valves to prevent back-flow. Pistons are either coupled to the diaphragm or used to force hydraulic oil to drive the diaphragm. Diaphragm pumps are normally highly reliable because they do not include internal parts that rub against each other. Diaphragm pumps can handle a range of media including abrasive materials, acids, chemicals, or the like since the drive means is normally completely separated from hydraulic part of the pump. Since diaphragm pumps can deliver small volumes of fluid with the maximum discharge, they are especially suitable as dosage pumps.

Another reason for using diaphragm pumps as dosage pumps is that these pumps have two strokes, i.e. an aspiration stroke in which the medium is aspirated from a reservoir and a compression stroke or delivery stroke where delivery of the metered medium e.g. into a metered line takes place. Diaphragm pumps known in the art for instance comprise suction check valves as well as discharge check valve to prevent back-flow. These check valves are usually spring biased and are opened and closed by the pressure difference of the medium to be pumped. The check valves are normally only operated by the differential pressure of the fluid. This compression spring exerts a comparatively low spring force in order to ensure that the check valve can easily be opened.

There is a permanent need to increase the cost efficiency of diaphragm pumps, and to improve the dosing capabilities of diaphragm pumps.

It is therefore an object of the present invention to provide an improved diaphragm pump which offers an increased cost efficiency, further it is desirable to increase the dosing capabilities of the diaphragm pump.

SUMMERY OF THE INVENTION

This object is solved by means of a diaphragm pump for dosing fluids, in particular for use as a detergent dosage pump, having the features of claim 1 and by means of a method of dosing a fluid having the features of claim 7. Preferred embodiments, additional details, features, characteristics and advantages of the object of the invention of said diaphragm pump and said method are disclosed in the subclaims.

In a general aspect of the invention the diaphragm pump, in particular for use as a detergent dosage pump, comprises a pump housing with at least a first check valve and a second check valve, a fluid chamber, a diaphragm defining a wall of the fluid chamber and reciprocatingly movable, a stepping motor as driving means for reciprocating said diaphragm, wherein the stepping motor comprises a controller for actuating the stepping motor, and an external control unit for operating the controller of the stepping motor, wherein the external control unit is connected to the controller by a power supply line for transmitting an operating signal to the controller, wherein the operating signal is a start signal for operating the diaphragm pump, in particular the stepping motor, at preset parameters.

A pump housing may accommodate a fluid chamber, a diaphragm and at least a first check valve and a second check valve, wherein the first check valve may allow a fluid to flow into the fluid chamber, for example during a suction cycle of the diaphragm pump, and the second check valve may allow the fluid to leave the fluid chamber, for example during a dosage cycle of the diaphragm pump, preventing the fluid flowing back into the fluid chamber after being expelled from the fluid chamber. In order to pump the fluid the diaphragm may define a wall of the fluid chamber, wherein the diaphragm may be reciprocating movable by a driving means in form of a stepping motor. The stepping motor may comprise a controller for controlling the operation of the diaphragm pump, in particular for controlling the stepping motor. The controller may control a driving speed of the stepping motor, wherein the driving speed may be a rotational speed measured in revolutions per minute. An for example external control unit may be connected to the controller by a power supply line, wherein the power supply line may, for example, comprise one or more, in particular two, wires. The power supply line may be configured for transmitting power to the diaphragm pump, and particularly to the stepping motor and/or the controller of the stepping motor, and for transmitting an operating signal from the external control unit to the controller in order to control the operation of the diaphragm pump, and particular of the stepping motor. The driving means may be an electric motor, for example a stepping motor, in particular a hybrid stepping motor. The operating signal transmitted from the external control unit to the controller via the power supply line, may be a start signal for operating the diaphragm pump, in particular the stepping motor, at preset parameters. The preset parameters may be stored inside the controller, in particular at least one preset parameter may be stored inside the controller of the stepping motor. For each preset parameter stored inside the controller may be started by an according operating signal transmitted from the control unit. Each operating signal sent from the control unit may correspond to an according preset parameter. Different parameters may correspond to different pumping properties of the diaphragm pump. Different operating signals may operate the diaphragm pump differently, for example with a different pump speed. By controlling and adjusting a pump speed the pump volume of the diaphragm pump may be adjusted accordingly.

The diaphragm pump according to the present invention has a few advantages over devices according to the state of the art. For example, by integrating the power supply and the transfer of operating signals from the control unit to the controller only a power supply line with for example two wires is needed, which enables the manufacturing costs of the diaphragm pump to be lowered, hence increasing the cost efficiency of the diaphragm pump. Also, the implementation of the preset parameters and the receiving of a corresponding operating signal as a start signal inside the controller may be done at low implementation costs. Furthermore, the preset parameters may be adapted to the used type of diaphragm pump, the desired operation, and for example the specific type of fluid to be dosed. Hence, improving the dosing capabilities of the diaphragm pump In another embodiment of the invention the power supply line is a pulse wide modulated power supply line for transmitting a pulse wide modulated operating signal to the controller. The power supply line may be a pulse-wide modulated power supply line, configured for transmitting a pulse-wide modulated operating signal from the control unit to the controller. The controller of the stepping motor may receive a pulse-wide modulated operating signal, which may be the start signal for operating the diaphragm pump at preset parameters. After receiving the pulse-wide modulated operating signal and starting to operate the diaphragm pump, in particular the stepping motor, the diaphragm pump continues to run at the preset parameters.

In another preferred embodiment of the invention the power supply line is a binary coded power supply line for transmitting a binary and/or digital coded operating signal to the controller. The power supply line may be a binary and/or digital coded power supply line configured for transmitting a binary and/or digital coded operating signal from the control unit to the controller of the diaphragm pump, in particular the stepping motor. The binary and/or digital coded operating signal may be digitally transmitted from the control unit to the controller. The controller may receive the binary and/or digital coded operating signal in order to start the diaphragm pump, in particular the stepping motor, at the preset parameters. After receiving the binary and/or digital coded operating signal and starting the diaphragm pump, the diaphragm pump may run at the preset parameters.

In a particularly preferred embodiment of the preset parameters comprise data about the driving speed of the pump and/or about the aspirating velocity of the pump. The preset parameters may comprise data about the driving speed of the pump, for example in revolutions per minute and/or in form of a percentage value ranging from 1% to 100% of the driving speed of the stepping motor. The preset parameters may comprise data about an aspirating velocity of the pump, which is the velocity of the pump at the beginning of a suction cycle, wherein the aspiration velocity may be different to the velocity of the diaphragm pump during a delivery stroke. The aspirating velocity may be chosen according to the viscosity of a fluid to be pumped, in order to avoid cavitations during the suction cycle. Different preset parameters may comprise different settings for example about the driving speed of the diaphragm pump and/or the aspirating velocity of the diaphragm pump.

Furthermore, in a preferred embodiment of the invention the preset parameters comprise a dosing backpressure limitation. The preset parameters may also comprise a dosing backpressure limitation, wherein the dosing backpressure limitation may be based on a monitoring of a stepping motor current. The controller may be monitoring the stepping motor current, and in case the stepping motor current reaches a preset pressure or backpressure limit, the stepping motor will be stopped and the stepping motor currents drawn by the stepping motor during a pumping cycle may correspond to a certain backpressure. The preset parameters may comprise a pump identifier, wherein the pump identifier corresponds to a predefined pumping volume and/or a maximum allowable dosing backpressure limitation. The dosing backpressure limitation may correspond to the backpressure during dosing a detergent and/or rinsing a fluid.

A further aspect of the present invention is a system, in particular a dosing system, comprising a diaphragm pump as described above.

A further aspect of the present invention is a method of controlling a diaphragm pump, in particular according to claim 1, comprising the steps of providing a diaphragm pump as described above, transmitting an operating signal from the control unit to the controller of the stepping motor via the power supply line, starting and operating of the stepping motor according to the operating signal, wherein the operating signal is a starting signal, in particular for operating the diaphragm pump, in particular the stepping motor, at preset parameters.

The diaphragm pump, in particular the stepping motor, may be started by transmitting an operating signal from the control unit to the controller of the stepping motor, wherein the operating signal corresponds to preset parameters. After receiving the transmitted operating signal the controller starts the stepping motor at the preset parameters, wherein the stepping motor continues to operate at the preset parameters for as long as the power necessary for operating the stepping motor is supplied from the control unit via the power supply line. For stopping the operating of the diaphragm pump, the power transferred from the control unit to the controller of the stepping motor may be interrupted so that the stepping motor comes to a hold and the diaphragm pump stops pumping. The method of controlling a diaphragm pump according to the invention has the advantage that due to the simplified construction of the pump, in particular by using a two wire power supply line for transmitting the power from the control unit to the stepping motor and for transmitting the operating signal, the cost-efficiency of the diaphragm pump is increased. Further, by adjusting the preset parameters to the type of pump, the desired operation and the type of fluid to be pumped, the dosing capabilities of the diaphragm pump can be increased.

In a preferred embodiment of the method the preset parameters comprise data about the driving speed of the pump and/or about the aspirating velocity of the pump and/or about a dosing backpressure limitation. Transmitting an operating signal corresponding to certain preset parameters may start the stepping motor at a predefined speed. According to the preset parameters the aspiration velocity of the diaphragm pump may be set and/or a certain dosing backpressure limitation may be set. The backpressure limitation may correspond to a setting of a stepping motor current value, which may be monitored by the controller of the stepping motor. On reaching the preset stepping motor current value the controller may stop the stepping motor, thus avoiding the diaphragm pump to be damaged. The stepping motor current measured by the controller may correspond to a certain backpressure. The preset parameter may also comprise a pump identifier, for identifying the type of pump desired for the operation. The pump identifier may set the diaphragm pump to pumping a predefined volume of fluid, and/or at a maximum backpressure. The pumping of the diaphragm pump may be the pumping of a detergent and/or a rinsing operation.

In a particularly preferred embodiment of the method the operating signal is a pulse wide modulated operating signal. The operating signal may be transmitted in form of a pulse-wide modulated operating signal from the for example external control unit to the controller of the stepping motor.

In a further preferred embodiment of the method the operating signal is a binary and/or digital coded operating signal. The transmitting of the operating signal may be transmitting a binary and/or digital coded operating signal from the control unit via the power supply line to the controller of the stepping motor. The binary and/or digital coded operating signal may comprise 12 bits, wherein a first may be a start bit and the last may be a stop bit, with 10 bits for information transfer in between. The 10 bits may be at 10 ms each and may be digitally transmitted from the external control unit to the controller of the stepping motor.

In a preferred embodiment the method further comprises the step of modulating the driving speed by disrupting the power supply to the controller and transmitting a new operating signal corresponding to different preset parameters. A driving speed of the diaphragm pump and thus the pumping volume of the diaphragm pump may be modulated by disrupting the power supply from the control unit to the controller and by transmitting a new operating signal corresponding to different preset parameters. The new preset parameters may correspond to a different pumping speed and pumping volume, for example with a different backpressure. The power supply may be disrupted for about 150 ms, before transmitting a new operating signal. This has the advantage that the speed of the diaphragm pump may be adjusted during normal mode of operation, thus varying the pumping volume during normal mode of operation.

In a preferred embodiment the method further comprises the step of preloading preset parameters by pulse wide modulated signals or binary and/or digital coded signals to the controller. Preset parameters may be preloaded to the controller by a pulse-wide modulated signal or a binary and/or digital coded signal sent from the control unit to the controller of the stepping motor. This has the advantage that new preset parameter may be newly transmitted from the control unit to the controller enabling an adaption of the diaphragm pump operating behaviour, for example according to a different type of fluid to be pumped.

DESCRIPTION OF THE FIGURES

Additional details, features, characteristics and advantages of the object of the invention are disclosed in the figures and the following description of the respective figures, which—in exemplary fashion—show one embodiment and an example of a dispensing system according to the invention. In the drawings:

The illustration in FIG. 1 shows an embodiment of the present invention. In FIG. 1 a diaphragm pump 10 is shown, comprising a pump housing 12. Inside the pump housing 12 two first check valves 14 and two second check valves 16 are located, wherein the first check valves 14 allow a fluid, not shown, to enter into a fluid chamber 18. During a dosing cycle the fluid is expelled from the fluid chamber 18 and moves through the opened second check valves 16, while the first check valves 14 are locked. One wall of the fluid chamber 18 is defined by a diaphragm 20, wherein the diaphragm 20 comprises a connector 22 which is connected to a con rod 24. The con rod 24 is attached to an eccentric 26, wherein the eccentric 26 is attached to a driving shaft 30 of a driving means in form of a stepping motor 28 for reciprocating the diaphragm 20. The con rod 24 is attached to the eccentric 26 by a ball bearing 32 for reducing the friction when the diaphragm pump 10 is operating. The stepping motor 28 is controlled by a controller 34. The controller 34 is connected to a control unit 36 by a power supply line 38, wherein the power supply line 38 comprises two wires for transmitting the power for operating the stepping motor 28 from the control unit 36 to the controller 34 as well as transmitting an operating signal for starting the stepping motor 28 from the control unit 36 to the controller 34, as shown in FIG. 2.

In FIG. 3A a pulse-wide modulated start sequence is shown, wherein the pump controller is started and a pulse-wide modulated operating signal 42 follows, wherein the pulse-wide modulation of the operating signal corresponds to preset parameters, which cause the diaphragm pump to start according to the preset parameters and continue to run according to the preset parameters. A binary and/or digital coded starting sequence is shown in FIG. 3B, wherein after starting the controller a binary and/or digital coded operating signal 46 is transmitted from the control unit to the controller via the power supply line. The binary and/or digital coded operating signal 46 corresponds to preset parameters, according to which the pump runs after starting up. A binary and/or digital coded starting sequence 44 is shown in FIG. 4, wherein after a 20 ms power up the operating signal 46 is transmitted. The binary and/or digital coded operating signal 46 comprises a start bit, which is followed by three pump identifier bits, followed by seven speed bits and at the end of the binary coded operating signal follows a stop bit indicating the end of the binary coded operating signal 46. The start and stop bit may comprise a 5 ms low voltage and 5 ms high voltage, wherein the 10 bit sequence in between may be 10 ms long for each bit.

Figure 1:
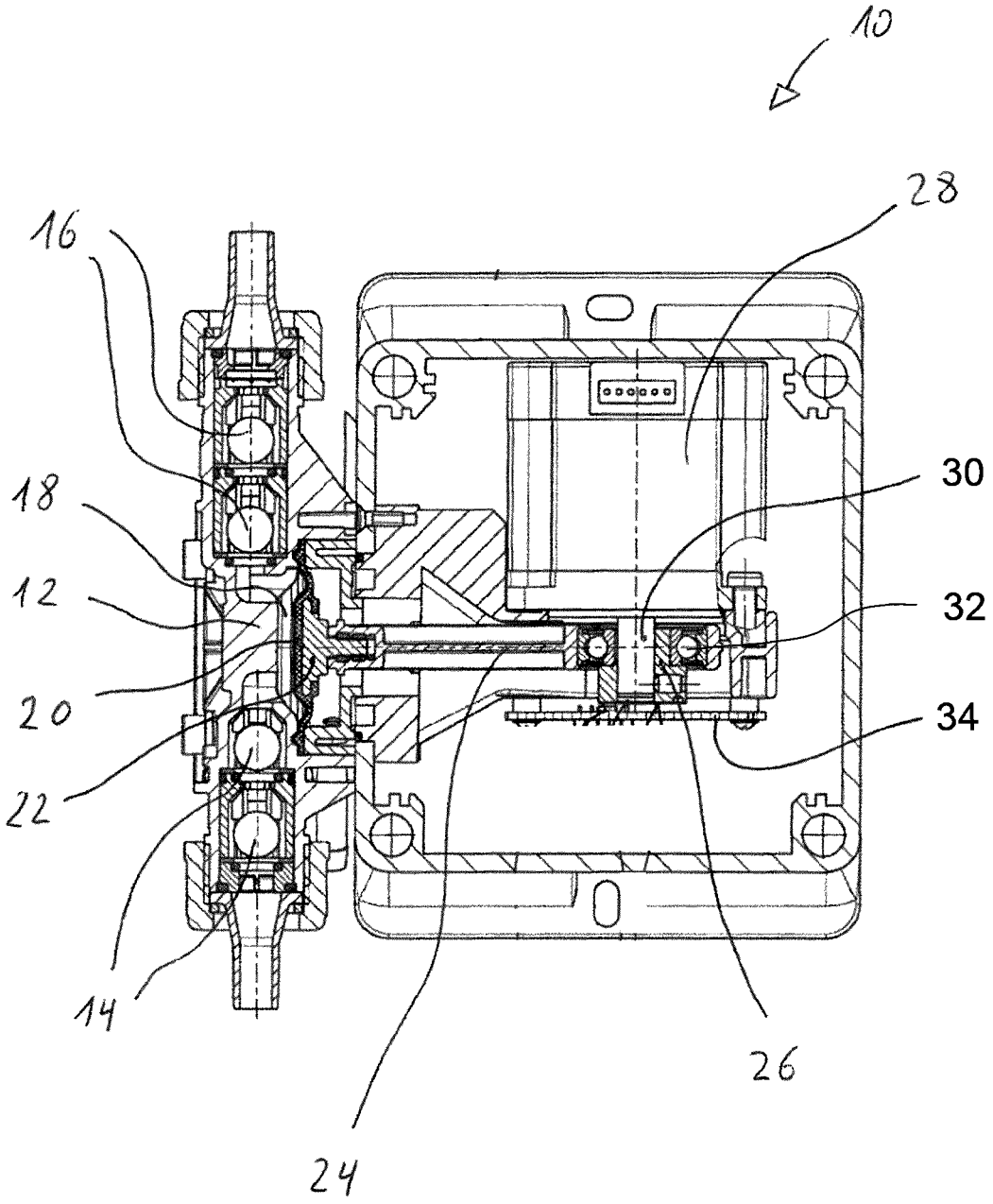
FIG. 1 shows a sectional drawing of diaphragm pump.
Figure 2:
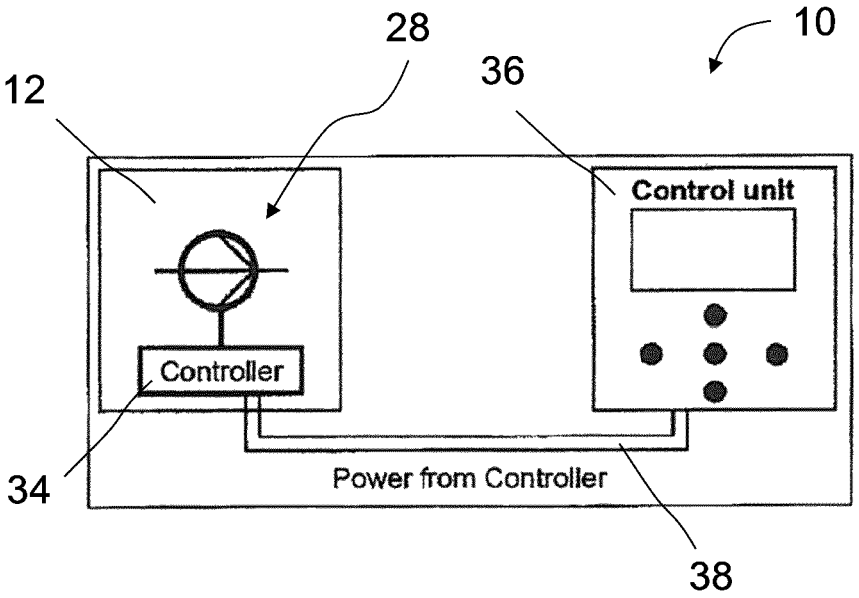
FIG. 2 shows a schematic drawing of a diaphragm pump and an external control unit.
Figure 3A:
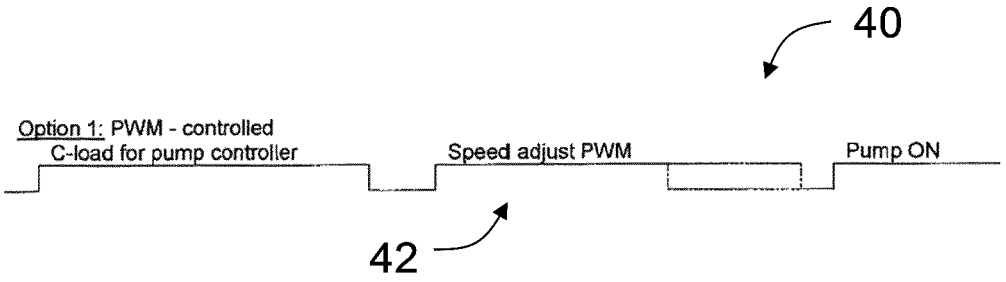
FIGS. 3A-B shows a pulse-wide modulated and a binary coded operating signal.
Figure 3B:
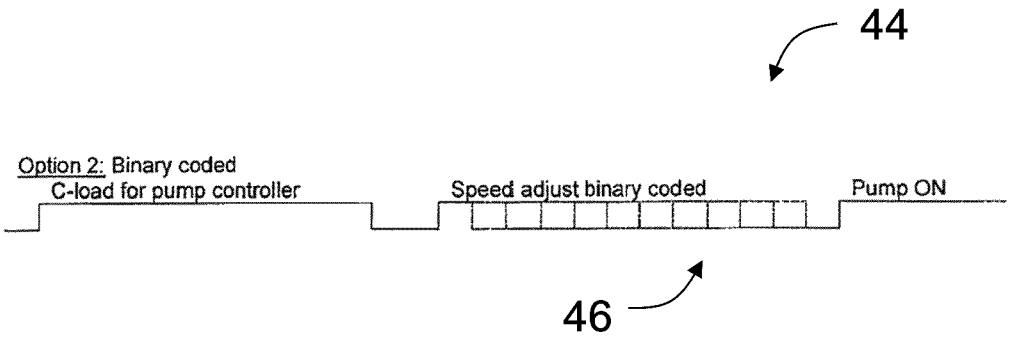
Figures 4, 5:
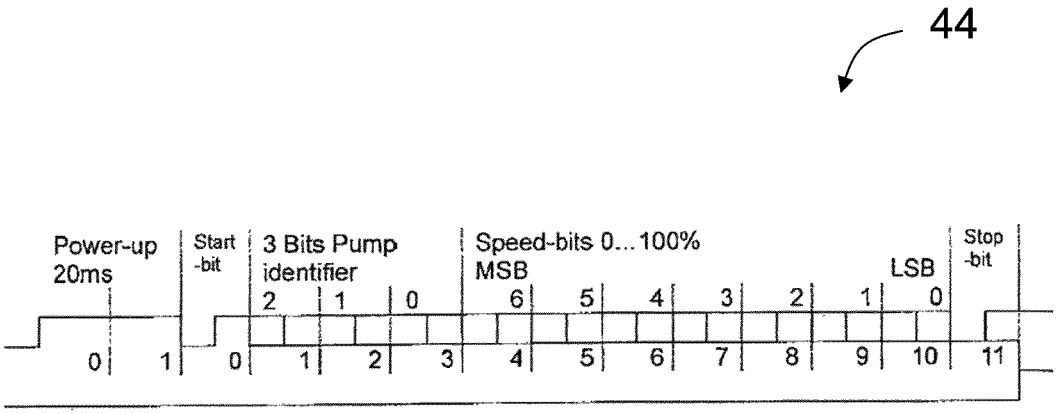
FIG. 4 shows a binary coded operating signal.
FIG. 5 shows a table of bits from a binary coded operating signal.

The bits and their according function are displayed in FIG. 5. The first three pump identifier bits may correspond to certain pump types, stored in the according preset parameters, for example may the three bit pump identifier sequence of 000 correspond to a preset parameter for a pump type pumping 20 litres of detergent to the maximum detergent backpressure of 3 bar. Three pump identifier bits in the order of 010 may correspond to a pump for pumping 1.4 litres for rinsing with a maximum backpressure of 10 bar. Seven speed bits follow the three pump identifier bits and indicate the pumping speed, for example in revolutions per minute, wherein the pumping speed in revolutions per minute may be stored in the corresponding preset parameters. Also the pumping speed may be indicated in percentages from 1 to 100% of the available pump speed. The seven speed bits are orientated from the most significant bit to the least significant bit. At the end of the binary coded operating signal a stop bit comprising a 5 ms low voltage and a 5 ms high voltage is transmitted from the external control unit to the controller, thus, indicating the end of the operating signal, enabling the diaphragm pump to continue running at the preset parameters corresponding to the transmitted operating signal.

The particular combinations of elements and features in the above detailed embodiments are exemplary only; the interchanging and substitution of these teachings with other teachings in this and the patents/applications incorporate by reference are also expressly contemplated. As those skilled in the art will recognize, variations, modifications, and other implementations of what is described herein can occur to those of ordinary skill in the art without departing from the spirit and the scope of the invention as claimed. Accordingly, the foregoing description is by the way of example only and is not intending as limiting. In the claims, the wording "comprising" does not exclude other elements or steps, and the identified article "a" or "an" does not exclude a plurality. The mere fact that certain measures are recited in mutually different dependent claims does not indicate that a combination of these measures cannot be used to advantage. The inventions scope is defined in the following claims and the equivalents thereto. Furthermore, reference signs used in the description and claims do not limit the scope of the invention as claimed.

LIST OF REFERENCE SIGNS

10 diaphragm pump
12 pump housing
14 first check valve
16 second check valve
18 fluid chamber
20 diaphragm
22 connector
24 con rod
26 eccentric
28 stepping motor
30 driving shaft
32 ball bearing
34 controller
36 control unit
38 power supply
40 pulse wide modulated start sequence
42 pulse wide modulated operating signal
44 binary coded starting signal
46 binary coded operating signal

The invention claimed is:

1. A diaphragm pump for use as a detergent dosage pump, comprising:
- a pump housing having at least a first check valve and a second check valve;
- a fluid chamber;
- a diaphragm defining a wall of the fluid chamber and reciprocatingly movable; and
- a stepping motor for reciprocating said diaphragm, the stepping motor comprising:
  - an internal controller for actuating the stepping motor,
  - an external control unit for operating the internal controller of the stepping motor, the external control unit being connected to the internal controller by a common line, the common line configured to transmit both an operating signal and power for operating the stepping motor from the external control unit to the internal controller, wherein
- the internal controller is located internal to the pump housing and the external control unit is located external to the pump housing,
- the operating signal is a start signal for operating the diaphragm pump and/or the stepping motor at at least one preset parameter, and
- a driving speed of the stepping motor is modulated by disrupting the power supply to the internal controller from the common line and transmitting a new operating signal corresponding to different preset parameters.

2. The diaphragm pump according to claim 1, wherein the common line is a pulse wide modulated common line for transmitting a pulse wide modulated operating signal to the internal controller.

3. The diaphragm pump according to claim 1, wherein the common line is a binary coded common line for transmitting a binary and/or digital coded operating signal to the internal controller.

4. The diaphragm pump of claim 3, wherein the binary coded operating signal is followed by a stop bit transmitted from the external control unit to the internal controller to indicate an end of the operating signal.

5. The diaphragm pump according to claim 1, wherein the preset parameters comprise data about the driving speed of the pump and/or about an aspirating velocity of the pump.

6. The diaphragm pump according to claim 1, wherein the preset parameters comprise a dosing backpressure limitation.

7. The diaphragm pump according to claim 6, wherein the dosing backpressure limitation is based on a stepping motor current monitored by the internal controller.

8. A dosing system, comprising the diaphragm pump according to claim 1.

9. The diaphragm pump of claim 1, wherein the preset parameters comprise data about pump types.

10. The diaphragm pump according to claim 1, wherein at least one of the preset parameters is stored inside the internal controller.

11. A method of controlling a diaphragm pump, comprising the steps of:
- providing a diaphragm pump, comprising:
  - a pump housing with at least a first check valve and a second check valve,
  - a fluid chamber,
  - a diaphragm defining a wall of the fluid chamber and reciprocatingly movable,
  - a stepping motor for reciprocating said diaphragm, the stepping motor comprising:
    - an internal controller for actuating the stepping motor, the internal controller being configured to monitor a stepping motor current, and
    - an external control unit for operating the internal controller, the external control unit being connected to the internal controller by a common line, wherein
    - the internal controller is located internal to the pump housing and the external control unit is located external to the pump housing;
- transmitting an operating signal from the external control unit to the internal controller of the stepping motor via the common line and transmitting power for operating the stepping motor via the common line;
- starting and operating the stepping motor according to the operating signal, wherein the operating signal is a starting signal for operating the diaphragm pump and/or the stepping motor at preset parameters; and
- modulating a driving speed by disrupting a power supply to the internal controller from a power supply line and transmitting a new operating signal corresponding to different preset parameters.

12. The method according to claim 11, wherein the preset parameters comprise data about the driving speed of the pump, about an aspirating velocity of the pump and/or about a dosing backpressure limitation.

13. The method according to claim 11, wherein the operating signal is a pulse wide modulated operating signal.

14. The method according to claim 11, wherein the operating signal is a binary and/or digital coded operating signal.

15. The method according to claim 11, further comprising the step of preloading the preset parameters by pulse wide modulated signals or binary and/or digital coded signals to the internal controller.

* * * * *